US006293315B1

(12) United States Patent
Froment et al.

(10) Patent No.: US 6,293,315 B1
(45) Date of Patent: Sep. 25, 2001

(54) PROCESS AND DEVICE FOR POSITIONING WEAVING LOOM WARP YARNS

(75) Inventors: Jean-Paul Froment, Doussard; Dominique Braun, Faverges, both of (FR)

(73) Assignee: Staubli Faverges, Faverges (FR)

( * ) Notice: Subject to any disclaimer, the term of this patent is extended or adjusted under 35 U.S.C. 154(b) by 0 days.

(21) Appl. No.: 09/597,992

(22) Filed: Jun. 19, 2000

(30) Foreign Application Priority Data

Jun. 25, 1999 (FR) ..... 99 08340

(51) Int. Cl.[7] ..... D03C 3/20
(52) U.S. Cl. ..... 139/55.1; 139/59; 139/455
(58) Field of Search ..... 139/55.1, 59, 455

(56) References Cited

U.S. PATENT DOCUMENTS

| | | | | |
|---|---|---|---|---|
| 3,817,292 | * | 6/1974 | Doehler et al. | 139/55.1 |
| 5,070,913 | * | 12/1991 | Palmer | 139/55.1 |
| 5,613,526 | | 3/1997 | Palau et al. . | |
| 5,803,133 | | 9/1998 | Slosse et al. . | |

FOREIGN PATENT DOCUMENTS

| | | | |
|---|---|---|---|
| 0353005 | | 1/1990 | (EP) . |
| 0774538 | | 5/1997 | (EP) . |
| 0879908 | | 11/1998 | (EP) . |
| 408081850 | * | 3/1996 | (JP) . |
| 9268450 | | 10/1997 | (JP) . |
| 9733024 | | 9/1997 | (WO) . |

* cited by examiner

*Primary Examiner*—Andy Falik
(74) *Attorney, Agent, or Firm*—Dowell & Dowell, P.C.

(57) ABSTRACT

A device for positioning warp yarns of a weaving loom which are controlled by electrical actuators for forming a shed which includes a first detector common to the warp yarns driven by a plurality of different actuators for detecting the passage of at least one warp yarn into a predetermined position, and a second device for determining a value of a control parameter of an actuator for controlling movement of the at least one warp yarn upon passage into the predetermined position. The process consists in displacing a warp yarn and detecting its passage into a predetermined position and selecting a value of a control parameter of an actuator for the warp yarn upon passage of the warp yarn into the predetermined position and in using the selected value as a control point for controlling an actuator for the warp yarn.

10 Claims, 3 Drawing Sheets

PROCESS AND DEVICE FOR POSITIONING WEAVING LOOM WARP YARNS

BACKGROUND OF THE INVENTION

1. Field of the Invention

The present invention relates to a process and a device for positioning warp yarns and to a weaving loom equipped with such a device.

2. Brief Discussion of the Related Art

In the domain of weaving looms of the Jacquard type, it is known to proceed with the levelling of the harness, i.e. with the adjustment, with respect to the frame of the weaving loom, of the position of the mails of the heddles in their direction of displacement in their substantially vertical reciprocating movement. The aim is to obtain a high-precision positioning of the warp yarns during weaving. In the known devices, such adjustment generally takes place in two steps:

- when the harness is manufactured, the harness cords are adjusted manually and individually to the and required length;
- when the Jacquard mechanism is positioned on its bearing structure, the positioning of this mechanism is adjusted by acting manually on jacks, in order to adjust the height of the mails of the heddles.

Such manual adjustments are long, fastidious, expensive and always imprecise, and their quality can be influenced if the operator is tired or lacks concentration.

It is a particular object of the present invention to overcome these drawbacks by proposing a device for positioning the warp yarns, which may be used automatically, with a precision and a reproducibility greatly improved over the known techniques.

SUMMARY OF THE INVENTION

To that end, the invention relates to a device for positioning warp yarns of a weaving loom, controlled for forming the shed by electrical actuators, which comprises a first detector, common to the yarns driven by different actuators, for detecting the passage of at least one warp yarn into a determined position and a second means for determining the value of a control parameter of the corresponding actuator upon passage of a yarn into this position.

Thanks to the invention, it is possible to displace a warp yarn or a group of warp yarns by activating an actuator to a predetermined position, which may be checked by to the first detector, while the second means makes it possible to acquire a value of a control parameter of the actuator which may then be used a control point for controlling the actuator.

According to a first advantageous embodiment of the invention, the first detector is a detection assembly fixed on a frame of the loom and comprising a source of emission of an undulatory signal and a cell disposed opposite this source with respect to the warp yarns and adapted to detect a variation of the undulatory signal. In particular, this source may be an emitter of a laser beam, while the cell is adapted to detect a variation in intensity of this beam which occurs when one of the warp yarns interferes with the laser beam.

According to a second embodiment of the invention, the first detector comprises a filiform sensor disposed in a direction parallel to the warp yarns of the loom.

According to a third embodiment, the first detector comprises a carriage movable along a support extending in a direction substantially parallel to the weft yarns of the loom. The carriage is equipped with a contact sensor adapted to selectively cooperate with one of the warp yarns. In that case, the carriage may be secured to an extension adapted to come into contact with certain warp yarns of the loom, the contacts between the warp yarns and the extension making it possible to generate a force of displacement of the carriage on the support.

Whatever the variant envisaged for the first detector, it can be employed automatically, i.e. in reproducible and reliable manner.

The invention also relates to a weaving loom comprising a device as described hereinabove. Such a loom operates more reliably and more precisely than known looms, while its installation and maintenance are largely simplified.

The invention also relates to a process for positioning the warp yarns of a weaving loom which may be carried out with the device described hereinabove and, more specifically, to a process which consists in:

- displacing at least one warp yarn by an of the actuator which is associated therewith;
- detecting the passage of the warp yarn into a predetermined position;
- selecting a value of a control parameter of the actuator upon passage of the yarn into the predetermined position; and
- using the selected value a control point for controlling the actuator.

This process has the advantage of being automated and of enabling the stroke of the heddles of a weaving loom to be adjusted by programming the electrical actuator associated with each heddle or group of heddles without manual intervention on the harness cords. In other words, the possible misalignments between the heddles and harness cords may be compensated by controlling the electrical actuator from the value selected as a control point which corresponds to the same position for the different warp yarns.

According to an advantageous aspect of the invention, the process consists in using the selected value of the parameter for determining at least one control point of the parameter corresponding to at least one particular position of the movement of the yarn generated by the actuator. Thanks to this aspect of the invention, the selected value allows the warp yarns to be positioned with precision along their entire path.

According to another advantageous aspect, the process is applicable when a plurality of warp yarns are displaced by to a single actuator, which is the case in a weaving loom equipped with a dobby or in a weaving loom of the Jacquard type with plural repeated patterns in the width of the fabric. In that case, the passage of at least one of the warp yarns driven by the actuator into the determined position is detected and the selected value of the parameter is used for controlling the actuator. For example, in a group of a plurality of yarns, the first yarn reaching the predetermined position and the last yarn reaching this position may be detected, the two values of the control parameter of the actuator being selected and used by a monitoring unit for controlling the actuator. The first value is able to be used for determining the bottom dead center of the corresponding stroke and the second value is used for determining the top dead center.

BRIEF DESCRIPTION OF THE DRAWINGS

The invention will be more readily understood on reading the following description of three embodiments of a device in accordance with its principle and of the processes for implementing them, given solely by way of example and with reference to the accompanying drawings, in which.

DESCRIPTION OF PREFERRED EMBODIMENTS

Figure 1:
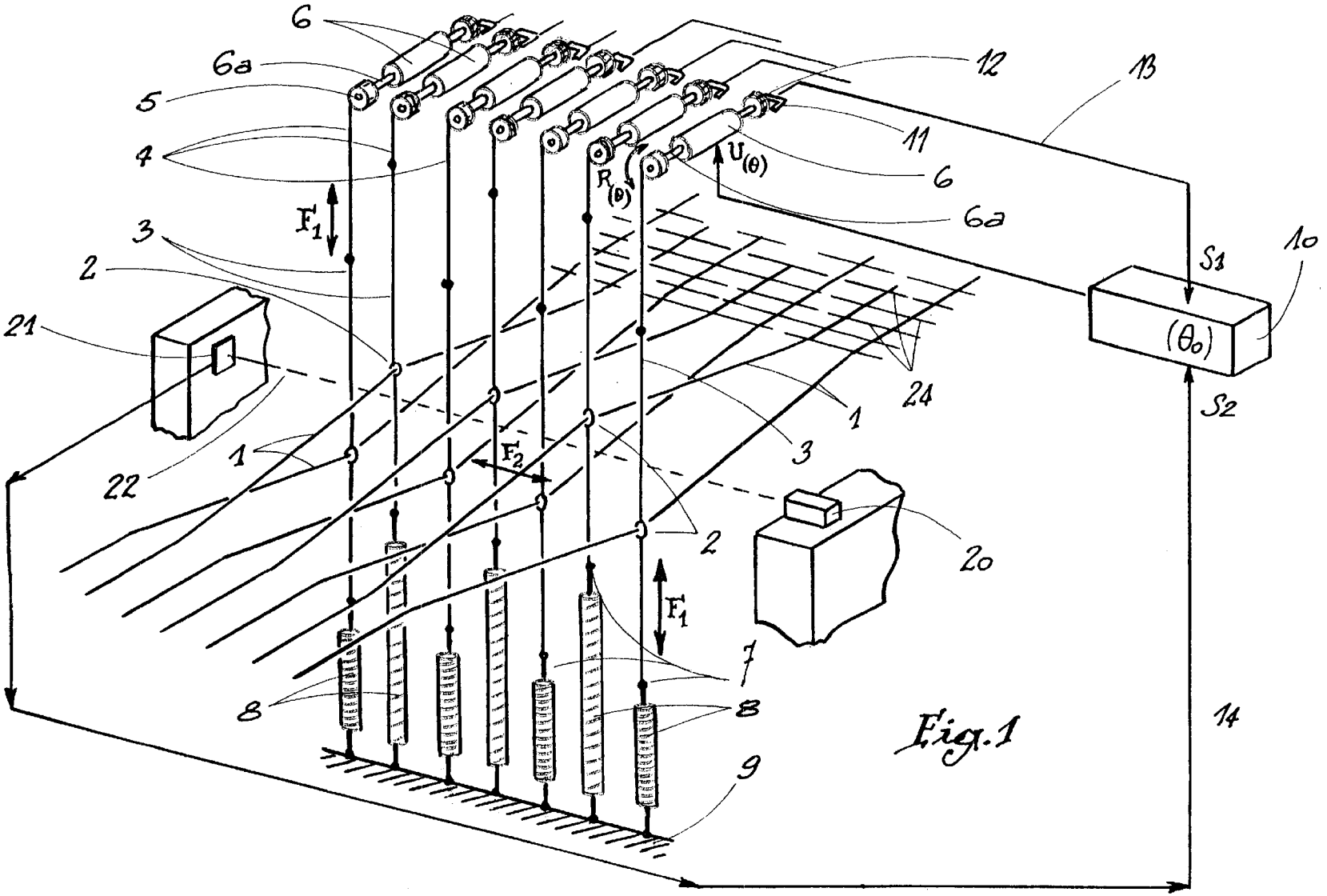
FIG. 1 schematically shows a weaving loom according to the invention.

Referring now to the drawings, the weaving loom schematically shown in FIG. 1 comprises warp yarns 1 each traversing a mail 2 of a heddle 3 animated by a vertical oscillating movement represented by arrow $F_1$ substantially perpendicular to the direction of movement of the weft yarns represented by arrow $F_2$. Each heddle 3 is connected by a cord 4 to a pulley 5 driven in rotation by an electric servo-motor 6. In its lower part, each heddle 3 is connected by a rod 7 to a spring 8 secured to the frame 9 of the loom.

As shown for the motor 6 located to the right in FIG. 1, each motor is controlled with the aid of a monitoring unit 10 which delivers to the motor 6 a control point corresponding to given angular positions of the motor. Each position may be defined by a parameter θ representative of the instantaneous angular position of rotation of the shaft 6*a* of the motor 6, the motor being controlled by using the parameter θ as a control point.

A detector 11 installed at the rear of each motor 6 is provided to cooperate with a dish 12 driven in rotation by the shaft 6*a*. An encoder formed by elements 11 and 12 allows a servo-control in position, for a precise control of the motor 6, thanks to a signal $S_1$ that it sends to the unit 10 via an electrical link 13.

A laser 20 is disposed opposite a target 21 so that the light beam 22 that it emits is substantially parallel to the direction $F_2$ of the weft yarns 24. The target 21 constitutes a sensor adapted to detect a variation in intensity of the beam 22 when this beam interferes with one of the warp yarns 1. Under these conditions, the cell 21 sends to unit 10, via an electrical link 14, a signal $S_2$ indicating that the warp yarn 1 in question is in the position of interference with the beam 22.

The process of positioning consists firstly in moving all the warp yarns away from the beam, taking them above or below it. Each yarn 1 is then successively displaced in the direction of the beam 22 until the assembly formed. by the elements 20 and 21 detects that the corresponding warp yarn 1 is in the position of intersection of the beam 22. Upon interference between a yarn 1 and the beam 22, the unit 10 memorizes a control point $\theta_o$ of the parameter θ which corresponds to this position for the corresponding actuator 6.

It is assumed that the laser 20 and the target 21 are arranged so that the beam 22 is slightly above the plane of crossing of the warp yarns, i.e. the median plane of the shed. $P_o$ denotes the position of the mail 2 of a heddle 3 when the yarn traversing this mail reaches the beam 22. Position $P_o$ corresponds to the value $\theta_o$ of the control parameter θ of the motor 6. This value $\theta_o$ may therefore be considered as corresponding to a reference position of the movement of the yarn 1.

From this position $P_o$, all the other positions of the heddle may be determined by the unit 10, by calculation. The top dead center and the bottom dead center of the path of the heddle may in particular be calculated.

According to variant embodiments of the invention, the means for detecting the position of the warp yarns may comprise a linear capacitive sensor disposed in direction $F_2$ of the weft yarns 24 of the loom.

Any light source may be used for the present invention, as long as a suitable cell is employed. Satisfactory results have been obtained with a helium-neon type gas laser and with a diode laser, which are products available on the market at competitive cost.

Figure 2:
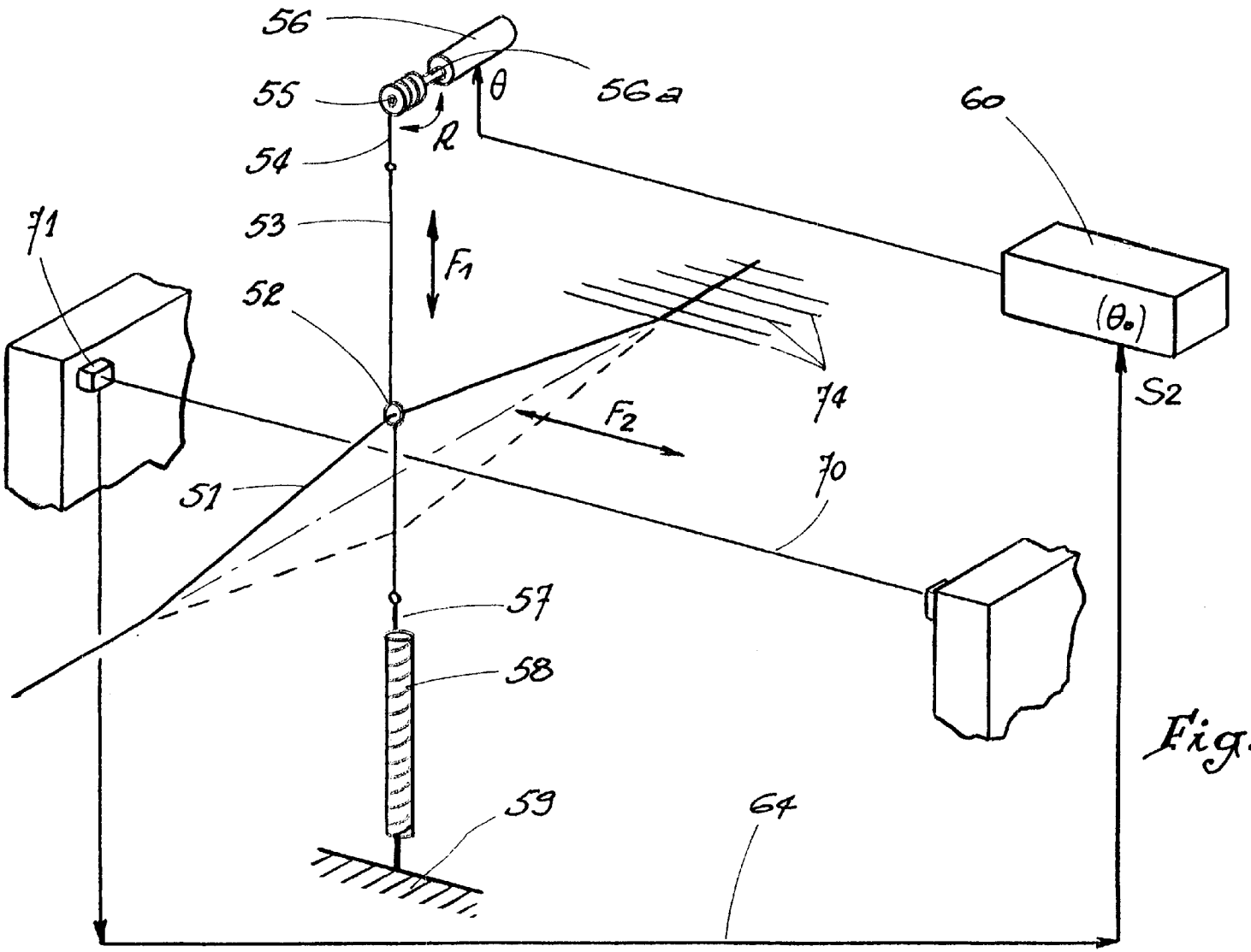
FIG. 2 is a view similar to FIG. 1 for a device in accordance with a second embodiment of the invention.

In the second embodiment of the invention shown in FIG. 2, elements similar to those of the first embodiment bear identical references increased by 50. In this second embodiment, only one heddle 53 for controlling the vertical displacement $F_1$ of a warp yarn 51 thanks to a mail 52, has been shown. This heddle is associated with a cord 54 provided to be wound over a pulley 55, this pulley being controlled in rotation R by a servomotor 56. In the lower part, a rod 57 connects the heddle 53 to a spring 58 secured to with the frame 59 of the loom. A unit 60 for monitoring the motor 56 makes it possible to control this motor in position as a function of the control points θ corresponding to each of the positions of its shaft 56*a*.

A yarn 70 is stretched, parallel to the direction $F_2$ of the weft yarn 74, between two parts of the frame of the loom and a sensor detects the arrival of a warp yarn 51 at its level as the contact between the yarns 51 and 70 generates vibrations which may be detected by a piezoelectric cell 71 connected by an electrical line 64 to the unit 60.

According to a variant of the invention which has not been shown, it is possible that the yarn 70 is not stretched between the two parts of the frame, in which case its exact geometry is taken into account in order to compensate the differences in height of the positions detected.

Whether the yarn is stretched or not, it may be possible to generate vertical vibrations on the yarn 51 thanks to the actuator 56, these vibrations being easily detected by the cell 71.

Impact of a warp yarn with yarn 70 is detected by the cell 71 which transmits a signal $S_2$ to unit 60 via an electric line 64. The unit 60 then selects the instantaneous control point $\theta_o$ of the control parameter θ as a reference value for determining the path of the heddle 53. As previously, this value may serve as base for determining, by calculation, all the positions of the heddle 53 and the yarn 51 associated therewith.

Figure 3:
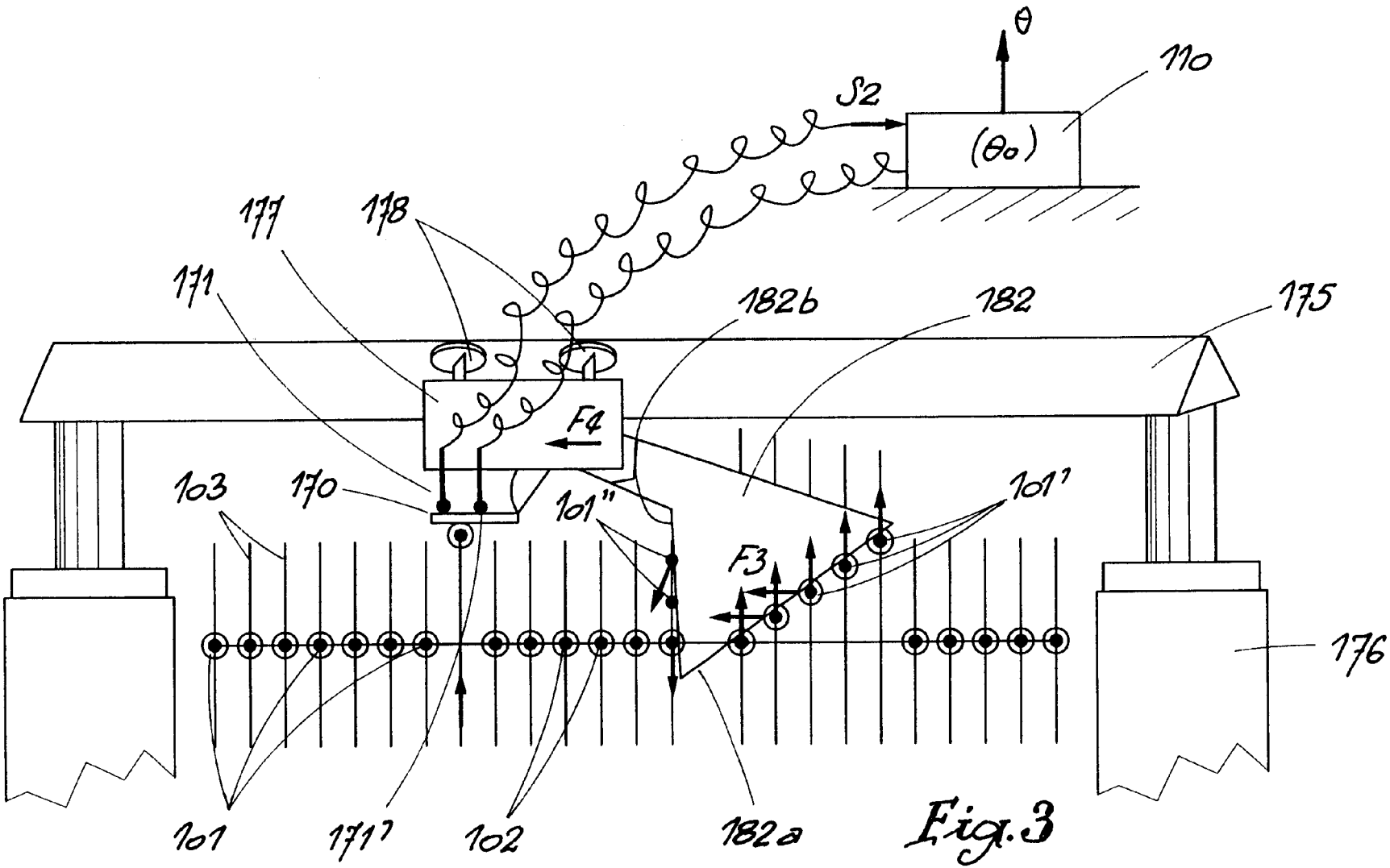
FIG. 3 is a front view of a device in accordance with a third embodiment of the invention.

In the third embodiment of the invention shown in FIG. 3, elements similar to those of the first embodiment bear identical references increased by 100. The warp yarns 101 of a weaving loom are provided to be displaced by heddles 103, said yarns passing through mails 102 thereof. A board 175 is disposed above the warp yarns parallel to direction $F_2$ of the weft yarns and in front of the harness of the loom, this board being in abutment on the frame 176 of the loom. A carriage 177 is movable in translation along the board 175 and is equipped with casters 178 enabling it to move without too much friction along the board 175. The carriage 177 bears a tongue 170 associated with two studs 71 and 171' which enables it to be electrically connected when a warp yarn 101 comes into abutment against its lower surface. The process of the invention consists in disposing the carriage 177 successively above each warp yarn and to raise this warp yarn until it exerts on the tongue 170 a force sufficient to close the electric circuit which comprises the studs 171 and 171', this having effect of transmitting a signal $S_2$ corresponding to this detection, via an electric link 114, to a unit 110 of the type such as unit 10 of the first embodiment. This signal $S_2$ is then processed as in the first and second embodiments.

The carriage 177 is equipped with an extension 182 adapted to cooperate with warp yarns other than the one whose displacement it is desired to measure. This extension 182 is provided with two surfaces 182*a* and 182*b* forming, for one, a ramp and, for the other, a stop, as will be understood from the following explanations. When it is desired to displace the carriage 177 from right to left in FIG. 3, an upward tractive effort is exerted on certain warp yarns 101', so that they come into abutment against the ramp 182*a*, their forces $F_3$ exerted on this ramp being converted into force directed towards the left in FIG. 3, as represented by arrows $F_3$. A second group of warp yarns 101" is also raised so that it forms a stop to the advance movement of the extension 182 under the effect of the forces $F_3$ by abutment of the surface 182*b* against themselves. When it is desired to advance the carriage 177 in the direction of arrow $F_4$, the yarns 101" are lowered and a new group of yarns 101' is raised.

The geometry of the extension 182 may, of course, be adapted as a function of the direction of displacement provided for the carriage 177.

The invention is also applicable to a single actuator displacing a plurality of heddles, for example to the case of a Jacquard type weaving loom intended to produce a fabric with repetitive patterns in the width. In that case, the precision obtained is lesser, as the heddles associated with a single actuator are not adjusted with respect to one another. These heddles are adjusted in groups between the different actuators by detecting, for example, the position of the highest warp yarn and the position of the lowest warp yarn when they successively arrive into a predetermined position from a low position. In that case, two values of the control parameter of the actuator are selected, these values each corresponding to the first or to the last yarn reaching this position. The value selected for the first yarn is used to determine the bottom dead center of the path of the heddles associated with the actuator, as this position determines the inner envelope of the shed in low position. Similarly, the value of the parameter selected for the last yarn reaching the predetermined position on rising, is used for determining the position of top dead center of the heddles associated with this group of yarns, as this position is determined by the low envelope of the upper shed. This process therefore enables an optimized opening of the shed to be obtained, including where a plurality of yarns are controlled with a single actuator.

According to a variant, it may be possible to establish an average between the values of the parameters selected for the highest yarn and the lowest yarn, this average value being used as control point for controlling the corresponding actuator.

Whatever the variant embodiment, a servo-control loop is created between the means 20, 21, 71, 170 or 171 for detecting the position of the warp yarns and the means 10, 60 or 110 for controlling the actuators. This loop makes it possible to control displacement of the warp yarns with high precision.

According to a variant of the invention which has not been shown, the signal $S_2$ can be transmitted to the control unit 10, 60, 110 or equivalent via a link other than an electric wire, as long as it transmits in real time.

Whatever the embodiment considered, the detection means 10, 21 or equivalent may be removably mounted on the loom and, in particular, be dismantled after levelling in order to be used on other looms.

The invention is applicable to weaving looms equipped with rotating or linear electric actuators controlled in open or closed loop.

Thanks to the invention, a weaving loom harness can be positioned automatically and with high precision, so that the stroke of the heddles may be optimized by reducing the distance between the upper position $P_1$ and lower position $P_2$ of their stroke, i.e. the opening of the shed, with the result that a weaving loom incorporating a device as described hereinabove can operate at very high speed and with an improved output.

The invention is also applicable to looms equipped with a dobby, the detection of the movement of the warp yarns associated with a frame in that case being effected in one operation, as in the case of a multi-pattern Jacquard loom.

What is claimed is:

1. A system for controlling electrical actuators for moving warp yarns in a weaving loom which includes, a first detector means common to, and arranged to detect movement of, a plurality of warp yarns being moved by the actuators for thereby detecting passage of each of the plurality of warp yarns when in a predetermined position, and a second means for determining a value of a control parameter for each of the electrical actuators which control the movement of the plurality of warp yarns upon detection of each of the plurality of warp yarns being in said predetermined position.

2. The system of claim 1, wherein said first detector means is a detection assembly adapted to be fixed on a frame of the weaving loom and including a source of emission of an undulatory signal and a cell disposed on an opposite side of said source with respect to said plurality of warp yarn and adapted to detecting variance of said undulatory signal.

3. The system of claim 2, wherein said source is an emitter of a laser beam, said cell being adapted to detect a variation in intensity of said laser beam which occurs when at least one of said plurality of warp yarns interferes with the laser beam.

4. The system of claim 1, wherein said first detector means includes a filiform sensor adapted to the disposed in a direction substantially parallel to weft yarns of the loom.

5. The system of claim 1, wherein said first detector means includes a carriage movable along a support adapted to extend in a direction substantially parallel to weft yarns of the loom, said carriage being equipped with a contact sensor adapted to selectively cooperate with at least one of said plurality of warp yarns.

6. The system of claim 5, wherein said carriage is mounted to an extension adapted to come into contact with certain warp yarns of the loom, contact between said certain warp yarns and said extension generating a force of displacement of said carriage on said support.

7. A weaving loom including a system for controlling electrical actuators for controlling movement of warp yarns which includes a first detector means common to and arranged to detect movement of a plurality of the warp yarns moved by a plurality of electrical actuators and for detecting passage of the plurality of warp yarns in a predetermined position, and second means for determining a value of a control parameter of the plurality of electrical actuators which move the plurality of warp yarns upon detection of the plurality of warp yarns in said predetermined position.

8. A process for positioning warp yarns of a weaving loom and for controlling formation of a shed by electrical actuators comprising the steps of:

a. displacing the warp yarns by means of actuators which are associated therewith;

b. using a dector common to a plurality of the warp yarns and detecting passage of the plurality of the warp yarns when in a predetermined position;

c. selecting a value of a control parameter of each of the actuators for the plurality of warp yarns upon passage of the plurality of warp yarns into said predetermined position; and d. using the selected values as control points for controlling the electrical actuators for the plurality of warp yarns.

9. The process of claim 8 including using the selected values for determining at least one control point of the control parameter corresponding to at least one particular position of a movement of each of the plurality of warp yarns generated by the actuators for displacing the plurality of warp yarns.

10. The process of claim 8 including displacing at least two of the plurality of warp yarns with a single actuator and detecting the passage of at least one of said at least two warp yarns in said predetermined position and using the selected value of said parameter for said at least one warp yarn for controlling the actuator for the at least two warp yarns.

* * * * *